US007429052B2

(12) United States Patent
Jeon

(10) Patent No.: US 7,429,052 B2
(45) Date of Patent: Sep. 30, 2008

(54) INLINE SKATES HAVING SHOCK ABSORBERS

(75) Inventor: Pil Dong Jeon, Seoul (KR)

(73) Assignee: Chang-Ho Hwangbo, Yeosu-Si, Jeollanam-Do (KR)

( * ) Notice: Subject to any disclaimer, the term of this patent is extended or adjusted under 35 U.S.C. 154(b) by 245 days.

(21) Appl. No.: 11/024,999

(22) Filed: Dec. 28, 2004

(65) Prior Publication Data

US 2006/0138735 A1 Jun. 29, 2006

(51) Int. Cl.
*A63C 17/06* (2006.01)

(52) U.S. Cl. ..... 280/11.223; 280/11.225; 280/11.28

(58) Field of Classification Search ..... 280/7.13, 280/11.225, 11.223, 11.28, 11.27
See application file for complete search history.

(56) References Cited

U.S. PATENT DOCUMENTS 1,609,612 A * 12/1926 Eskeland ..... 280/11.223
5,085,445 A * 2/1992 Boyden ..... 280/11.227
5,536,025 A * 7/1996 Landay ..... 280/11.225
5,704,620 A * 1/1998 Oliemans et al. ..... 280/11.225
5,704,621 A * 1/1998 Lazarevich et al. ..... 280/11.28
5,709,396 A * 1/1998 Zorzi et al. ..... 280/11.28
5,816,588 A * 10/1998 Nicoletti ..... 280/11.231
5,895,061 A * 4/1999 Gignoux ..... 280/11.214
5,918,889 A * 7/1999 Tai ..... 280/11.225
5,951,027 A * 9/1999 Oyen et al. ..... 280/11.225
6,012,727 A * 1/2000 Chang ..... 280/11.28
6,086,072 A * 7/2000 Prus ..... 280/11.28
6,270,089 B1 * 8/2001 Marechal ..... 280/11.3
6,270,090 B1 * 8/2001 Gignoux ..... 280/11.33
6,276,696 B1 * 8/2001 Wong ..... 280/11.222
6,334,621 B1 * 1/2002 Chang ..... 280/11.3
6,354,608 B1 * 3/2002 Syrkos ..... 280/11.225
6,382,638 B1 * 5/2002 Lee ..... 280/7.13
6,416,063 B1 * 7/2002 Stillinger et al. ..... 280/11.223
6,454,280 B1 * 9/2002 Longino ..... 280/11.28
6,491,309 B1 * 12/2002 Sheldon ..... 280/11.27
6,644,673 B2 * 11/2003 Longino ..... 280/11.28
7,048,281 B2 * 5/2006 Longino ..... 280/11.221

* cited by examiner

*Primary Examiner*—Jeffrey J Restifo
(74) *Attorney, Agent, or Firm*—GWiPS

(57) ABSTRACT

An inline skate mounting a pair of air tubes is invented for absorbing shock transmitted to its wheels so as to allow the use of rigid wheels, and to protect the rider's knees and ankles from shock. The inline skate comprises a frame having insertion compartments for mounting the shock absorbers, guide recesses, brackets for defining desired spaces, and a wheel holder having supporting plates. The wheels are coupled to and supported by the sides of the supporting plate and inserted into the guide recesses so that the wheel holder moves upward and downward when an external force is applied so as to transmit the external force to the shock absorbers. The shock absorbers are inserted into the insertion compartments and filled with air to absorb the external force when the wheel holder moves vertically. Since the wheel holder moves vertically as the skate traverses an uneven surface, the inline skater can balance stably and safely.

4 Claims, 5 Drawing Sheets

INLINE SKATES HAVING SHOCK ABSORBERS

BACKGROUND OF THE INVENTION

1. Field of the Invention

The present invention relates to an inline skate provided with a shock absorber, and more particularly to an inline skate in which a plurality of air tubes for absorbing shocks transmitted to the respective wheels is installed at the inner upper end of a wheel bracket so as to allow the use of wheels having high hardness, to effectively increase the rolling speed of the wheels, to secure rider's safety, and to protect the knees and ankles from shock.

2. Description of the Related Prior Art

As is well-known, a conventional inline skate, not shown, includes a boot body for receiving and fixing a rider's foot, a wheel bracket attached to the lower side of the boot body, and a plurality of wheels fixed by bearings installed to the wheel bracket that allow the boot body to roll.

The conventional inline skate exhibits excellent skating performance but insufficient walking performance. Due to these drawbacks, riders feel inconvenienced since they must wear ordinary shoes instead of the inline skates when climbing stairs or due to the fact that traveling a long distance while wearing the inline skates is uncomfortable. If the rider attempts to avoid the inconvenience of having to change into ordinary shoes when climbing stairs by attempting to climb the stairs in the inline skates, it is very dangerous in that the rider may slip and fall.

Moreover, since the conventional inline skate is equipped with bearings installed between the wheels and the wheel bracket for reducing friction of the wheels, sand may be introduced into the bearings and the bearings may be damaged due to the sand as the sand wears down the bearing during the rotation of the bearing.

In addition, since the boots of the conventional inline skates are heavy, they are inconvenient to carry and store.

For the purpose of overcoming the above disadvantages, roller shoes have been developed. At the rear bottom surface of the roller shoe, a roller is positioned such that its surface is exposed below that of the tread of the shoe. To use the roller shoe the rider lifts the front end of the roller shoe so as to travel for a desired distance using the roller. To be sure, since the roller is detachable, the rider can wear the roller shoes like the ordinary shoes.

However, it is difficult for the user to maintain their balance when using the roller function of the roller shoe as they must delicately concentrate their weight over the rear end of the shoe. As such, it is difficult to travel at any substantial speed using the roller shoes. Moreover, it is impossible to propel oneself using the conventional side thrust technique used when inline skating, and, as such, users must build up speed by running on their toes and then arching the foot back onto the roller to glide for some distance.

In addition, since the conventional inline skate and the roller shoes have no structure for absorbing shock from the ground, the boot must be reinforced so as to prevent the user's ankles from damage, thus increasing the weight thereof. Since the boot must be sufficiently tall to completely cover the ankles, the boot becomes very heavy so that it is inconvenient to carry. Though the boot is sufficiently high, the user's ankles and knees may be damaged due to impacting the ground during use or if the user collides with an obstacle.

When the wheels travel over an obstacle, since the conventional inline skate has no structure for absorbing shock, excellent balance is required to adapt to the shape of obstacles, and the user may lose his/her balance when traveling over the obstacle. This principle can be compared to riding a motorcycle without a shock absorber or a spring, where even a small obstacle generates a large shock.

In addition, the wheels of conventional inline skates are made of urethane so that they may exhibit a slight shock-absorbing effect of their own. However, since friction between these soft wheels and the ground is increased, it is difficult to accelerate and the wheels of the conventional inline skate wear out rapidly.

SUMMARY OF THE INVENTION

Therefore, the present invention has been made in view of the above and other problems, and it is an object of the present invention to provide an inline skate in which a plurality of air tubes for absorbing shock transmitted to the wheels is installed at the inner upper end of a wheel bracket, thus allowing use of extremely rigid wheels, which effectively increases rolling speed of the wheels, and serving to enhance the rider's safety, and to protect the rider's knees and ankles from shock.

In accordance with the present invention, the above and other objects can be accomplished by the provision of an inline skate with a shock absorber including: a wheel bracket installed to the lower side of an outsole of an ordinary shoe, a plurality of wheels coupled to the inner lower sides of the wheel bracket and supported by shafts, a rotating support coupled to the rear upper side of the wheel bracket by a shaft and coupled to a connecting protrusion from the outsole of the ordinary shoe so as to prevent the wheel bracket from separating from the outsole, a frame constituting the wheel bracket, and having insertion compartment formed at the inner upper sides of the frame that receive a plurality of shock absorbers, a plurality of guide recesses oriented perpendicular to the insertion compartment, brackets, protruding between the guide recesses, for defining desired spaces, a wheel holder having supporting plates in which the wheels are coupled to and supported by the sides of the supporting plate, and inserted into the guide recesses so that the wheel holder can move vertically when an external force is applied so as to transmit the external force to the shock absorbers, and shock absorbers inserted into the insertion compartment and filled with air so as to dissipate the external force when the wheel holder moves upward and downward.

Preferably, each guide recess has a connecting protrusion extending from the inner upper side of the guide recess to a certain height, and a longitudinal guide slot formed at the lower side of the guide recess.

Each supporting plate has a guide slot formed at the upper side of the supporting plate, into which the connecting protrusion is inserted and guided vertically, and a connecting protrusion formed at the outer lower side of the supporting plate that is inserted into the guide slot of the guide recess.

Each shock absorber includes a housing made of soft synthetic resin, predetermined spaces formed at the sides of the housing, air tubes installed in the predetermined spaces, a cover sheet wrapped around the housing, and a connecting part made of the same material as the housing, disposed at the midsection of the housing, and integrated with the housing.

BRIEF DESCRIPTION OF THE DRAWINGS

FIG. 5 is a side partial cross-sectional view illustrating the mechanics of shock absorption by the inline skate with a shock absorber according to the preferred embodiment of the present invention.

DESCRIPTION OF THE PREFERRED EMBODIMENTS

Hereinafter, an inline skate with a shock absorber according to the preferred embodiment of the present invention will be described with reference to the accompanying drawings.

Figure 1:
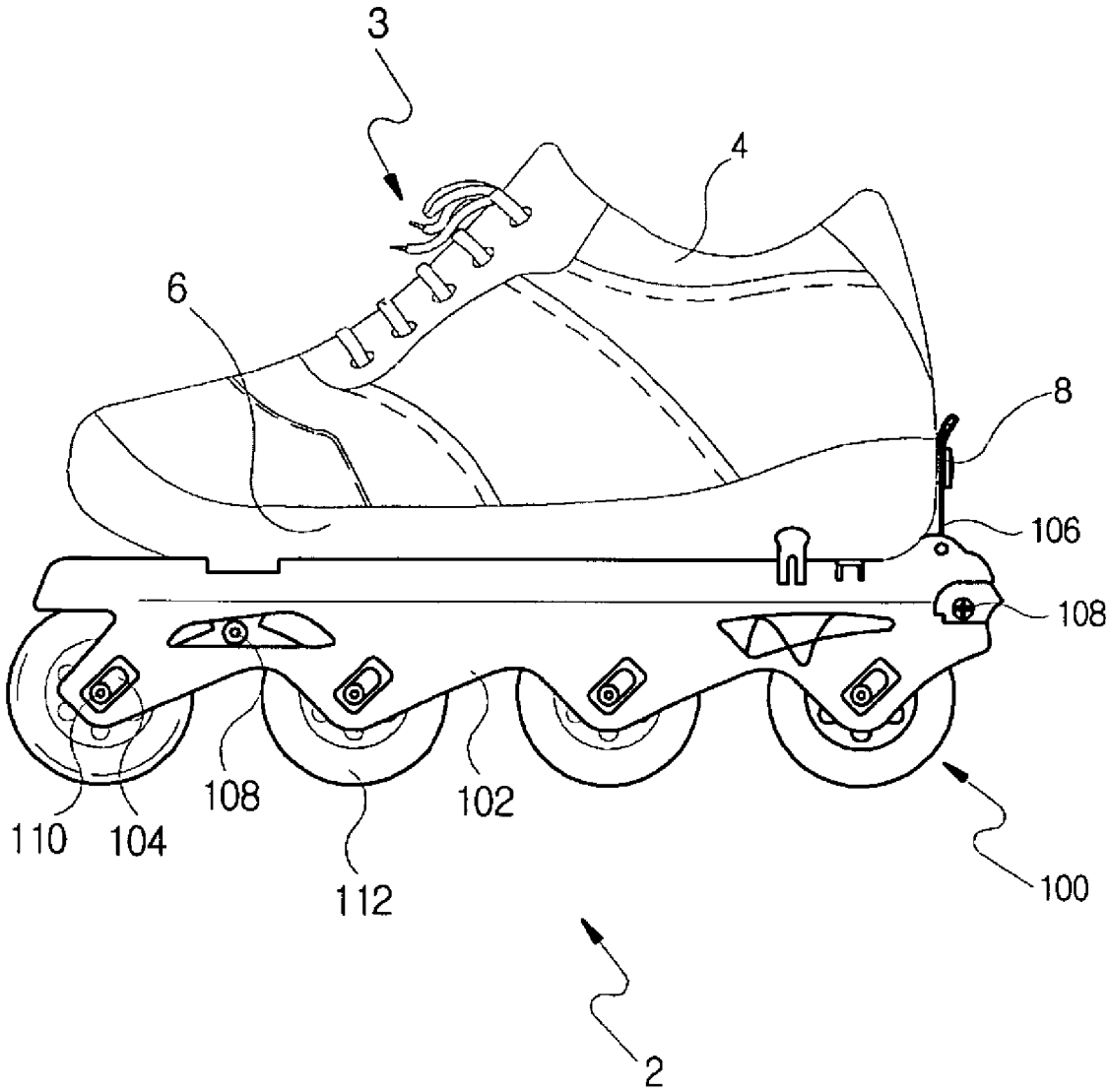
FIG. 1 is a side view illustrating an inline skate with a shock absorber according to the preferred embodiment of the present invention.

FIG. 1 is a side view illustrating the inline skate with a shock absorber according to the preferred embodiment of the present invention.

As shown in the drawing, the inline skate 2 with a shock absorber is an inline skate in which a plurality of air tubes for absorbing shock transmitted to respective wheels is installed at the inner upper end of a wheel bracket, thus allowing the use of extremely rigid wheels, which effectively increases the rolling speed of the wheels, serving to enhance the rider's safety, and protecting the rider's knees and ankles from shock.

The inline skate 2 with a shock absorber according to the preferred embodiment of the present invention includes a shoe part 3 having an ordinary shoe 4, and a wheel bracket 100 installed on the lower side of the shoe part 3 and having a plurality of wheels 112 mounted at the inside of the wheel bracket 100 and exposed to the lower side of the wheel bracket 100.

The shoe part 3 can use an ordinary shoe, but it is preferable to use a shoe 4 having an upper section, an insole, and an outsole 6 that are all relatively thicker than those of the ordinary shoe, and a relatively long ankle portion. Moreover, the rear side, (i.e., the heel portion) of the shoe 4 of the shoe part 3 has a connecting protrusion 8.

The wheel bracket 100 includes a frame 102 having a shape similar to the lower frame of the ordinary inline skate, longitudinal guide slots 104, formed at the lower side of the frame 102, for guiding the connecting protrusions 110 of the wheel supports (See FIGS. 2 and 3) to be connected to the wheel bracket 100 and moved upward and downward within the guide slots 104, and a supporting holder 106 provided at the rear upper side of the frame 102 and connected to the connecting protrusion 8 provided at the rear side of the shoe 4.

The connecting protrusion 8 and the supporting holder 106 are connected to each other such that the wheel bracket 100 is separated from the shoe part 3.

The wheel bracket 100 is divided into two parts in the longitudinal direction, and the frame 102 includes a plurality of screws 108 for fixing the two divided parts of the wheel bracket 100.

Figure 2:
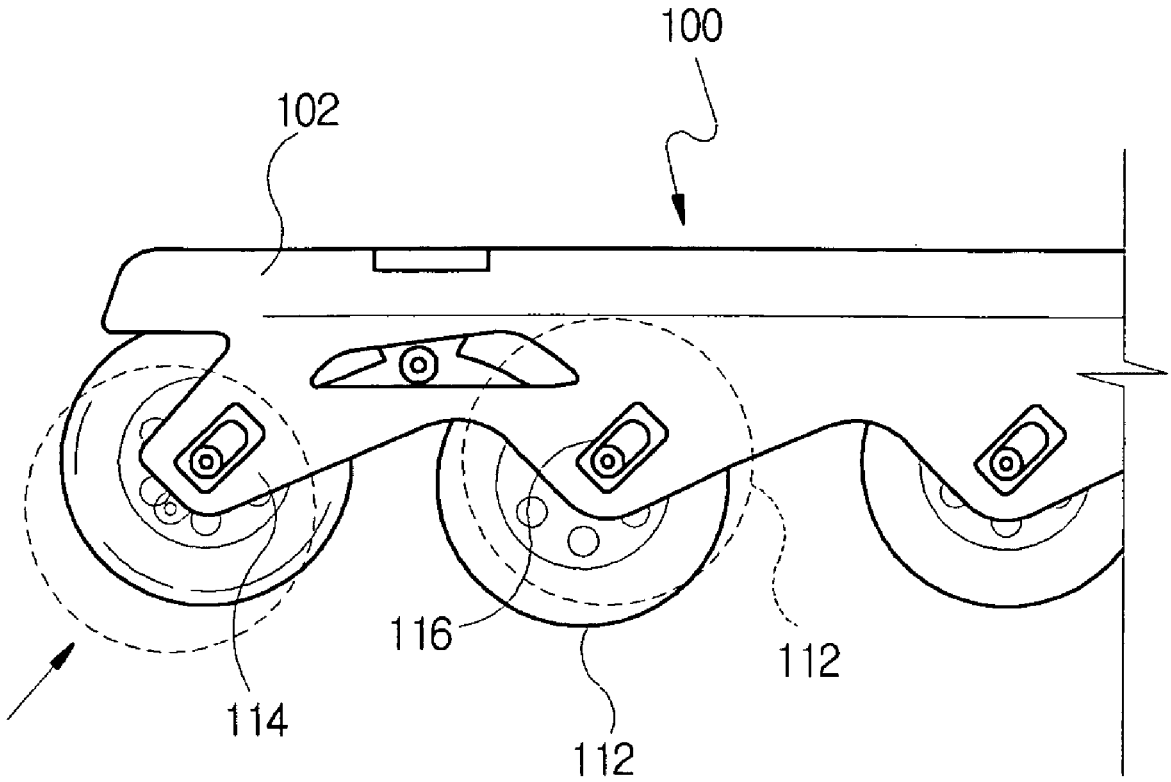
FIG. 2 is a partial side view illustrating the mechanics of shock absorption by the inline skate with a shock absorber according to the preferred embodiment of the present invention.
Figure 3:
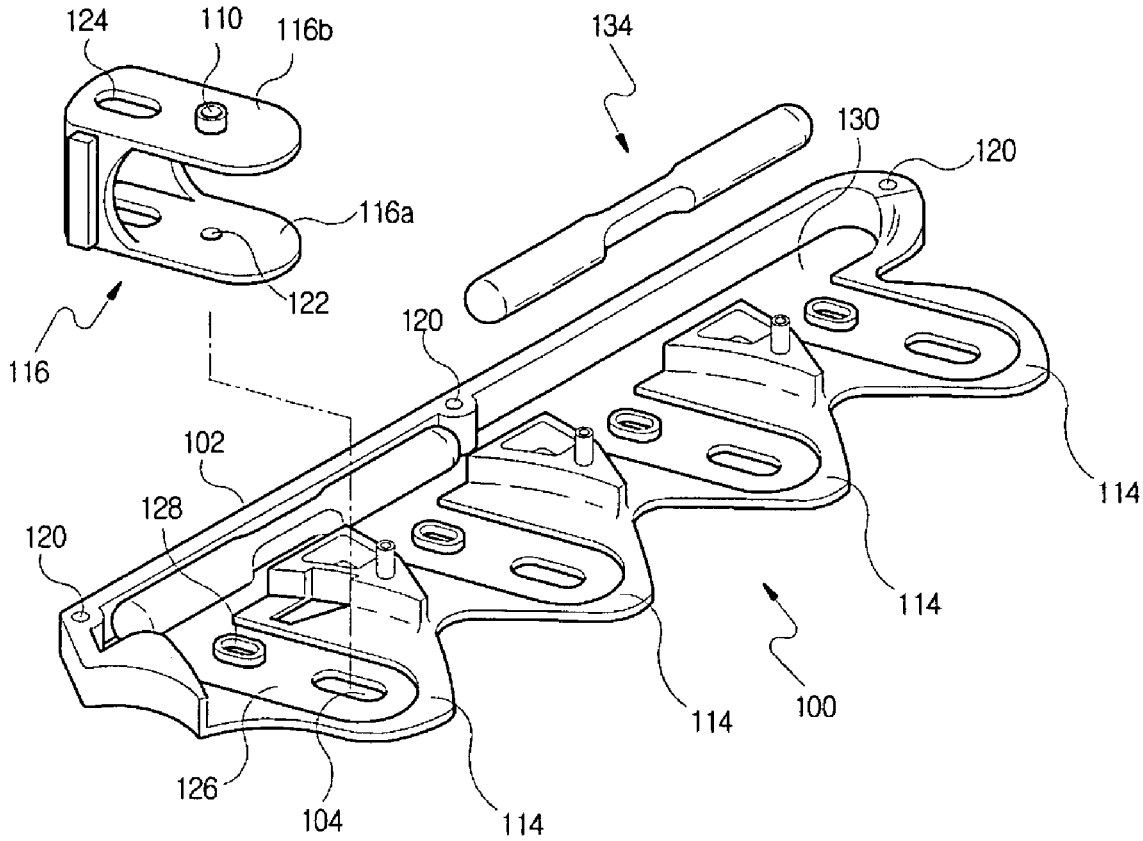
FIG. 3 is a partially exploded perspective view illustrating the structure of the inline skate with a shock absorber according to the preferred embodiment of the present invention.

FIG. 2 is a partial side view illustrating the mechanics of shock absorption by the inline skate with a shock absorber according to the preferred embodiment of the present invention, and FIG. 3 is a partially exploded perspective view illustrating the structure of the inline skate with a shock absorber according to the preferred embodiment of the present invention.

As shown in the drawings, in the inline skate 2 with a shock absorber according to the preferred embodiment of the present invention, only one of the two parts of the wheel bracket 100 is depicted in FIG. 3. The frame 102 has longitudinal insertion compartment 130 formed at its inner upper side which accommodate a shock absorber 134, and a lower wheel support 114 formed with a guide recess 126 for guiding a wheel holder 116 in the tilted direction. The wheel holder 116 is inserted into the guide recess 126 and moves upward and downward when receiving impact from the wheels 112.

In addition, the frame 102 is formed with a plurality of screw holes 120 at the upper edge of the frame 102, and is provided with a plurality of brackets 132 protruding between the wheel supports 114 and defining desired spaces having a width equal to the thickness of the wheel holder 116.

The guide recess 126 includes a connecting protrusion 128 formed at the inner upper side thereof and protruding to a certain height, and a longitudinal guide slots 104 formed at the inner lower side thereof.

The wheel holder 116 accommodated in the guide recess 126 supports the wheel 112. The wheel holder 116 includes supporting plates 116*a* and 116*b* coupled to the sides of the wheel 112 so as to support the wheel 112, and the supporting plates 116*a* and 116*b* are connected to each other at their upper sides so as to accommodate part of the wheel 112 and to expose the rest of the wheel 112 to be in contact with the ground.

Guide slots 124 are formed in the upper sides of the supporting plates 116*a* and 116*b* and guide the connecting protrusion 128 of the guide recess 126 when being inserted thereinto, and the connecting protrusions 110 protrude from the outer lower sides of the supporting plates 116*a* and 116*b* and are inserted into the longitudinal guide slots 104. Shaft holes 122 are formed in the inner lower sides of the supporting plates 116*a* and 116*b* to receive the shafts of the wheel 112.

In other words, the guide slots 124 of the upper sides of the supporting plates 116*a* and 116*b* of the wheel holder 116 are connected to the connecting protrusions 128 at the upper sides of the guide recesses 126, while the connecting protrusions 110 at the outer lower sides of the supporting plates 116*a* and 116*b* of the wheel holder 116 are inserted into the guide slots 104 at the lower sides of the guide recesses 126. Since the guide slots 124 and 104 are equal in length to the connecting protrusions 128 and 110 and are coupled to parts of the guide slots 124 and 104, the shock absorbers 134 absorb shock in correspondence to the freedom of movement of the connecting protrusions 128 and 110 within the guide slots 124 and 104.

Therefore, according to the inline skate 2 with a shock absorber in accordance with the preferred embodiment of the present invention, since air tubes are provided at the inner upper side of the wheel support so as to absorb shock transmitted from the respective wheels, wheels having high hardness can be used to effectively increase the rolling speed of the wheels and to enhance the rider's safety.

Figure 4A:
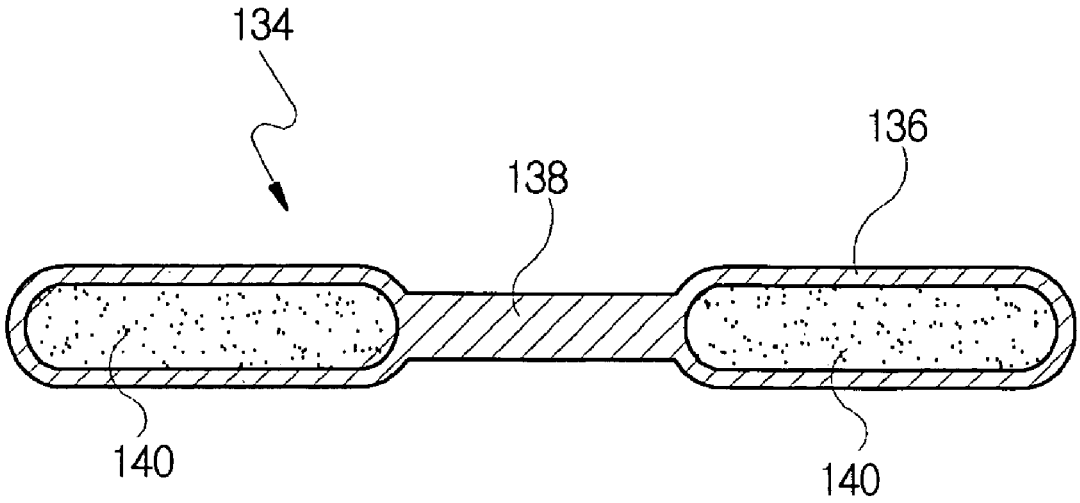
FIGS. 4*a* and 4*b* are cross-sectional views illustrating an air tube installed in the inline skate with a shock absorber according to the preferred embodiment of the present invention.
Figure 4B:
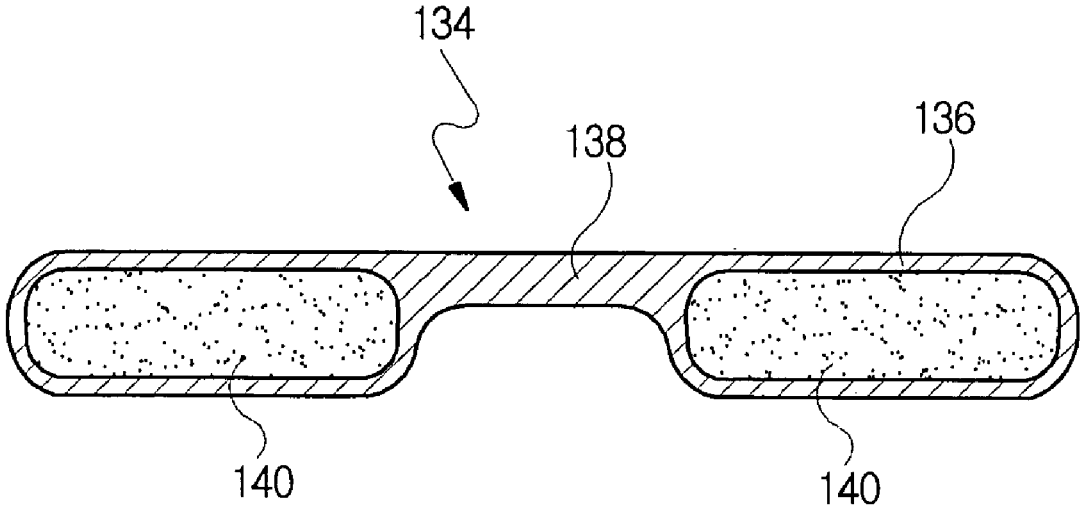

FIGS. 4*a* and 4*b* are cross-sectional views illustrating an air tube installed in the inline skate with a shock absorber according to the preferred embodiment of the present invention.

As shown in the drawings, the inline skate 2 with a shock absorber according to the preferred embodiment of the present invention includes shock absorbers 134 so as to absorb shock transmitted from the wheels 112. The shock absorbers 134 have vertical cross-sections as shown in FIG. 4*a*. In other words, each shock absorber 134 includes a soft synthetic resin housing 136 which is formed with predetermined spaces at the sides, into which air tubes 140 are installed.

Moreover, since a cover sheet (not shown) is wrapped around the housing 136, the air tubes 140 will not become separated from the housing 136. A connecting part 138 of the same material as that of the housing 136 is disposed at the midsection of the housing 136 and is integrated with the housing 136.

The shock absorbers 134 are inserted into the insertion compartments 130 horizontally formed at the upper side of the frame 102. Four shock absorbers 134 are installed in a plurality of frames 102 constituting the wheel bracket 100, while a single shock absorber 134 includes two air tubes 140 at the sides thereof.

Figure 5:
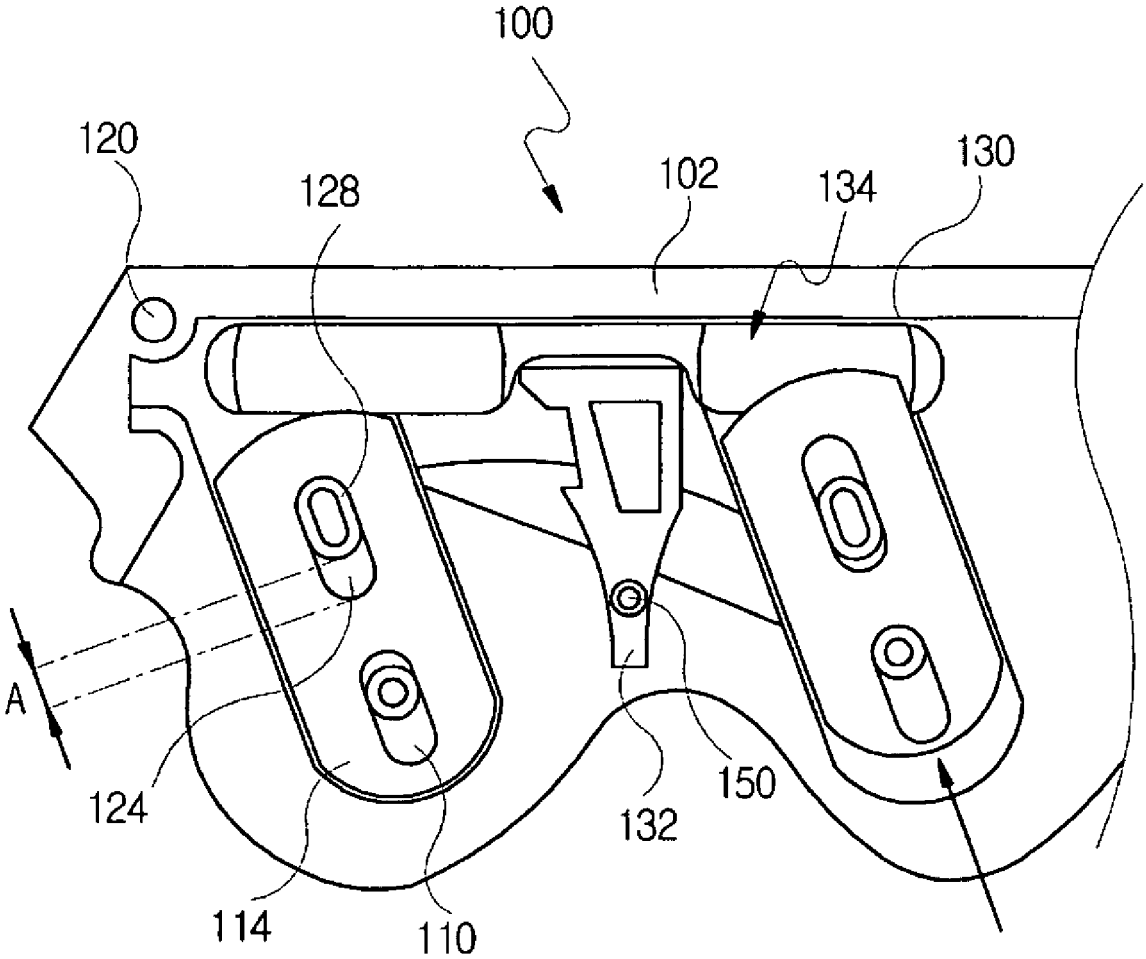
FIG. 5 is a side cutaway view illustrating the mechanics of shock absorption by the inline skate with a shock absorber according to the preferred embodiment of the present invention.

FIG. 5 is a side cutaway view illustrating the mechanics of shock absorption by the inline skate with a shock absorber according to the preferred embodiment of the present invention.

As shown in FIG. 5, in the inline skate 2 with a shock absorber according to the preferred embodiment of the present invention, the connecting protrusions 128 formed at the upper sides of the guide recesses 126 are inserted into the guide slots 124 formed in the upper sides of the supporting plates 116*a* and 116*b* of the wheel holder 116, and the connecting protrusions 110 formed at the outer lower sides of the supporting plates 116*a* and 116*b* of the wheel holder 116 are inserted into the guide slots 104 formed in the lower sides of the guide recesses 126.

Moreover, since the guide slots 124 and 104 are equal in length to the connecting protrusions 128 and 110 and are coupled to parts of the guide slots 124 and 104, the shock absorbers 134 absorb shock in correspondence to the freedom of movement of the connecting protrusions 128 and 110 within the guide slots 124 and 104.

Thus, as shown in FIG. 5, since, if stones or other obstacles protruding from the ground impact the wheel holder 116 (disposed at the right side as seen in FIG. 5), the wheel holder 116 moves toward the shock absorber 134 and the guide slots 124 of the wheel holder 116 move upward in the direction of the connecting protrusions 128 of the guide recesses 126, as is shown in FIG. 6, and the connecting protrusions 110 formed at the lower sides of the wheel holder 116 move upward within the guide slots 104 formed at the lower sides of the guide recesses 126.

Therefore, since the upper sides of the wheel holder 116 press one of the air tubes 140 of the shock absorbers 134, the shock transmitted to the wheel holder 116 is absorbed via the distortion of the air tube 140 and thus is not transmitted to the outsole. Since the wheel 112 receiving the shock from the uneven ground moves to a higher position than that of an undisturbed wheel 112, the rider can balance while rolling on the uneven ground.

Moreover, according to the inline skate 2 with a shock absorber in accordance with the preferred embodiment of the present invention, since the shock is absorbed by the wheel bracket 100 installed on the lower side of the outsole, urethane wheels are not required, and wheels 112 having high hardness can be used. Thus, due to the increased hardness of the wheels, riders are capable of skating much faster using the inline shoe 2 according to the present invention.

As described above, an inline skate with a shock absorber according to the present invention includes air tubes provided at the inner upper sides of the wheel bracket which absorb shocks transmitted from the wheels so that wheels having high hardness can be employed to increase the rolling speed of the wheels. Since the wheel holder moves vertically as the skate traverses the surface of the uneven ground, the rider can balance easily and the rider's safety can be secured.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An inline skate comprising:

a wheel bracket installed to the lower side of an outsole of an ordinary shoe, a plurality of wheels coupled and supported to the inner lower sides of the wheel bracket by shafts, a rotating support coupled to the rear upper side of the wheel bracket by a shaft, and coupled to a connecting protrusion extending from the outsole of the ordinary shoe so as to prevent the wheel bracket from being separated from the outsole, a frame constituting the wheel bracket, and having insertion compartments formed at the inner upper sides for mounting a pair of shock absorbers, a plurality of guide recesses in the direction perpendicular to the insertion compartments, and having brackets, protruding between the guide recesses, for defining desired spaces, a wheel holder having supporting plates in which the wheels are coupled to and supported by the sides of the supporting plate, and inserted into the guide recesses so that the wheel holder is moved vertically by applying an external force, and shock absorbers inserted into the insertion compartments and filled with air so as to dissipate absorb the external force when the wheel holder moves vertically.

2. The inline skate as set forth in claim 1, wherein each guide recess has a connecting protrusion extending from the inner upper side of the guide recess to a certain height, and a longitudinal guide slot formed at the lower side of the guide recess.

3. The inline skate as set forth in claim 2, wherein each supporting plate has a guide slot formed in the upper side of the supporting plate, into which the connecting protrusion is inserted and guided vertically, and a connecting protrusion formed at the outer lower side of the supporting plate that is inserted into the guide slot of the guide recess.

4. The inline skate as set forth in claim 1, wherein said shock absorbers further comprising:

a housing made of soft synthetic resin, predetermined spaces formed at the sides of the housing, air tubes installed in the predetermined spaces, a cover sheet wrapped around the housing, and a connecting part made of the same material as the housing, disposed at the midsection of the housing, and integrated with the housing.

* * * * *